US007934343B2

(12) United States Patent
Fletcher et al.

(10) Patent No.: US 7,934,343 B2
(45) Date of Patent: May 3, 2011

(54) CAST-IN ANCHORS

(75) Inventors: Geoff Fletcher, Croydon North (AU); Robert Urquhart Connell, Hawthorn East (AU)

(73) Assignee: Cetram Pty Limited, Victoria (AU)

( * ) Notice: Subject to any disclaimer, the term of this patent is extended or adjusted under 35 U.S.C. 154(b) by 782 days.

(21) Appl. No.: 11/399,613

(22) Filed: Apr. 7, 2006

(65) Prior Publication Data

US 2006/0248813 A1 Nov. 9, 2006

(30) Foreign Application Priority Data

Apr. 7, 2005 (AU) ..... 2005901724
Jul. 20, 2005 (AU) ..... 2005903846
Jan. 9, 2006 (AU) ..... 2006900092

(51) Int. Cl.
*E02D 35/00* (2006.01)

(52) U.S. Cl. ..... 52/125.5; 411/488

(58) Field of Classification Search ..... 52/125.5, 52/125.4, 125.2; 411/451.1, 452, 451.3, 411/446, 456, 466, 468, 488
See application file for complete search history.

(56) References Cited

U.S. PATENT DOCUMENTS

| | | | | | |
|---|---|---|---|---|---|
| 202,786 | A | * | 4/1878 | Dunham | 256/53 |
| 308,837 | A | * | 12/1884 | Frost | 411/448 |
| 1,921,514 | A | * | 8/1933 | Farrell | 411/493 |
| 1,948,093 | A | | 2/1934 | Baird et al. | |
| 2,034,080 | A | * | 3/1936 | Bitzenburger | 403/249 |
| 2,344,206 | A | | 3/1944 | Forni | |
| 2,527,063 | A | | 10/1950 | Heuer | |
| 2,649,831 | A | * | 8/1953 | Anstett | 411/80.1 |
| 3,466,967 | A | * | 9/1969 | Hallock | 411/477 |
| 3,499,359 | A | * | 3/1970 | Yrjanainen | 411/451.3 |
| 3,618,447 | A | * | 11/1971 | Goins | 411/456 |
| 3,855,688 | A | * | 12/1974 | Knohl | 29/432 |
| 3,874,263 | A | * | 4/1975 | Barth et al. | 411/474 |
| 4,175,728 | A | * | 11/1979 | Ferguson | 269/91 |
| 4,718,212 | A | * | 1/1988 | Illich | 52/699 |
| 5,137,112 | A | * | 8/1992 | Nichols | 182/3 |
| 5,150,865 | A | * | 9/1992 | Miller | 248/71 |
| 5,393,186 | A | * | 2/1995 | Holloway | 411/475 |
| 5,509,769 | A | * | 4/1996 | Larson et al. | 411/456 |
| 5,843,084 | A | * | 12/1998 | Hart et al. | 606/77 |

(Continued)

FOREIGN PATENT DOCUMENTS

| | | | |
|---|---|---|---|
| AU | 642641 | B2 | 10/1993 |
| AU | 199894225 | B2 | 6/1999 |
| AU | 751863 | B2 | 8/2002 |
| DE | 7032714 | | 12/1970 |

(Continued)

OTHER PUBLICATIONS

EP Search Report for EP06251903 dated Jun. 23, 2008.

*Primary Examiner* — Jeanette E Chapman
*Assistant Examiner* — Daniel Kenny
(74) *Attorney, Agent, or Firm* — Lowe Hauptman Ham & Berner, LLP

(57) ABSTRACT

An anchor for embedment into a concrete component, has a head via which load is applied to the anchor in use and an anchoring formation provided by at least one leg extending from the head and profiled along an edge thereof so as to lock into the surrounding concrete. The profile is formed by a series of longitudinally spaced formations each of generally saw-toothed shape with a leading edge of each formation inclining towards the head such that on application of a pulling load to the head the leg will lock tighter into the concrete with increasing load.

7 Claims, 11 Drawing Sheets

U.S. PATENT DOCUMENTS

| | | | | |
|---|---|---|---|---|
| D429,628 | S * | 8/2000 | Peters | D8/390 |
| 6,126,372 | A * | 10/2000 | Takata | 411/513 |
| 7,207,150 | B2 * | 4/2007 | Leek et al. | 52/747.1 |
| 2003/0019169 | A1 | 1/2003 | Francies, III et al. | |

FOREIGN PATENT DOCUMENTS

| | | |
|---|---|---|
| EP | 0088825 A2 | 9/1983 |
| FR | 1184868 | 7/1959 |
| WO | 9010763 A1 | 9/1990 |

* cited by examiner

CAST-IN ANCHORS

RELATED APPLICATIONS

The present application is based on, and claims priority from, Australian Application Numbers 2005901724, 2005903846 & 2006900092 filed Apr. 7 & Jul. 20, 2005 and Jan. 9, 2006, respectively, the disclosures of which are hereby incorporated by reference herein in its entirety.

BACKGROUND OF THE INVENTION

1) Field of the Invention

The present invention relates to anchors intended to be incorporated into a concrete component prior to casting, for example lifting anchors to provide a lifting point by which the component can be lifted during subsequent erection, and anchors for providing a fixing point for other components post-erection.

2) Description of the Prior Art

Concrete lifting systems for lifting of concrete panels, beams and other components typically involve the use of lifting anchors incorporated into the component during casting, with the head of the anchor being encased within a removable or disposable hollow void former to form within the surface of the component a recess within which the head of the anchor lies for releasable coupling to lifting equipment.

Different types of lifting anchor are required for different components, loads, and type of lift. FIG. 1 shows an anchor which has been widely used for edge lifting of concrete panels although it can also be used for edge lifting of other components. As shown in FIG. 1 the anchor comprises opposed parallel legs 2 of wave like or meandering form extending from a head 4. The particular head shown is designed for use with a releasable lifting clutch in the form of a ring clutch having an arcuate locking bolt received within an eye 6 in the head and which remains exposed within the recess after casting. Typically, this type of anchor is formed from a thick metal plate using non-contact high energy cutting means such as a laser beam or plasma arc.

As mentioned, anchors of the type shown in FIG. 1 have a principal utility in the edge lifting of concrete panels and in that usage the anchor is installed within the panel such that it traverses the thickness dimension of the panel with each of the two legs 2 lying adjacent to the respective faces of the panel. The two legs 2 lie either side of reinforcing mesh in the central median plane of the panel and one or more shear bars or tension bars are incorporated into the apertures 8 shown in the head in order to tie the anchor into the reinforcing structure of the panel; the details of the actual tie-in will depend on the actual loading to which the anchor is to be subjected and also to the type of lift which can be either straight edge lift or edge lift with tilt-up.

When installed, there is a relatively small thickness of concrete between each leg 2 and the adjacent face of the panel. During lifting, the meandering profile of the leg interacting with the concrete to the inside and outside of the leg provides on the leg opposing lateral forces which are normally in equilibrium in order to prevent lateral deflection of the leg. However a potential failure mode with this type of anchor arises if the strength of the concrete to the outside of the leg is insufficient to withstand the forces acting on the leg from its inner face and acting in a sense to force the leg outwardly. If such failure were to arise, the leg would be deflected outwardly and would "burst through" the adjacent face of the panel. In order to avoid this type of failure, existing anchors of this type are designed with legs which are sufficiently long to provide load distribution over a long leg length such that "burst through" in the circumstances just described, should not arise.

With existing anchors of this type, the need to produce the anchor with relatively long legs increases the material costs and also can sometimes complicate the installation of the anchor prior to casting.

SUMMARY OF THE INVENTION

According to one aspect of the present invention there is provided a lifting anchor for embedment into a concrete component, the lifting anchor having a head for releasable engagement with lifting equipment and generally parallel legs extending from the head, the legs being profiled so as to lock into the surrounding concrete and the profile being such that during lifting with the anchor and load being directed generally vertically the resultant of the forces acting on the leg is such that there is no, or substantially no, component of that force acting in a sense to deflect that leg laterally outwardly.

Particularly advantageously the profiling of the leg is such that the resultant of the forces acting on the leg acts laterally inwardly in a direction towards the other leg.

In a preferred embodiment, the effect is achieved by profiling the inner edge of the leg with a series of longitudinally spaced formations which lock into the concrete, each of the formations inclining upwardly and inwardly so as to face towards the head. With this arrangement the leg tends to lock tighter into the concrete as the load increases.

With this configuration, the outer edge of the leg can be kept straight and this is of particular advantage when the anchor is being cut out of thick metal plate by laser beam or plasma arc as cutting in a straight line is able to be accomplished significantly more quickly than when cutting along a complex path. It is however within the scope of the invention for the outer edge of the leg also to be suitably profiled.

According to another aspect of the invention there is provided an anchor for embedment into a concrete component, the anchor having a head portion via which load is applied to the anchor in use and an anchoring formation provided by at least one leg extending from the head portion and profiled along an edge thereof so as to lock into the surrounding concrete, the profiling being formed by a series of longitudinally spaced formations each of generally saw-toothed shape with a leading edge of each formation inclining towards the head such that on application of a pulling load to the head the leg will lock tighter into the concrete with increasing load.

When using an anchor as described above, it is envisaged that a tension bar to increase the load capacity of the anchor can be installed between the two legs adjacent to the underside of the head but without actually physically contacting the head as there will be load transmission between the tension bar and the head via the intervening concrete.

Accordingly, according to yet another aspect of the invention there is provided a lifting system using a lifting anchor of the general type defined above installed into a concrete component with a tension bar mounted between the legs of the anchor beneath its head.

The concept of having a straight-cut outer edge can, due to its manufacturing benefits, also have applicability to an anchor of this general type with a more conventional profiling.

Accordingly, according to yet another aspect of the present invention there is provided a lifting anchor for embedment into a concrete component, the lifting anchor having a head for releasable engagement with lifting equipment and generally parallel legs extending from the head portion, wherein the anchor is cut from metal plate material using a high energy non-contact cutter, the outer edge of each leg is cut along substantially its entire length with a straight cut, and the inner edge of each leg is cut to form a profile which locks with the surrounding concrete.

The inventive principles discussed above in relation to anchors having a pair of generally parallel legs are also applicable to an anchor having a single leg or other elongate anchoring formation projecting from the anchor head.

Accordingly, according to yet another aspect of the invention there is provided a lifting anchor for embedment into a concrete component, the lifting anchor having a head for releasable engagement with lifting equipment and an anchoring formation extending from the head, the anchoring formation being profiled so as to lock into the surrounding concrete and the profile being such that during lifting with the anchor and load directed generally vertically the resultant of the forces acting on the anchoring formation is such that there is no, or substantially no, component of that force acting in a sense to deflect the formation laterally outwardly towards an immediately adjacent face of the concrete component.

Although the present invention in some aspects is primarily applicable to lifting anchors, it is also applicable to other forms of cast-in anchor.

Accordingly to yet another aspect of the invention there is provided an anchor for embedment into a concrete component, the anchor having an anchoring formation provided by at least one leg so profiled as to lock into the surrounding concrete, the profile being such that when load is applied to the anchor in the axial direction of the leg, the resultant of the forces acting on the leg is such that there is no, or substantially no, component of that force acting in a sense to deflect the leg laterally outwardly towards an immediately adjacent face of the concrete component.

According to yet another aspect of the invention there is provided an anchor for embedment into a concrete component, the anchor having an anchoring formation comprising at least one set of generally parallel legs so profiled as to lock into the surrounding concrete, the profile being such that when load is applied to the anchor in the axial direction of the legs, the resultant of the forces acting on each leg is such that there is no, or substantially no, component of that force acting in a sense to deflect the leg laterally outwardly with respect to the other legs of the set.

When applied to a plate anchor each leg extends transversely to the plane of the plate of the anchor with one or more legs extending from each of two opposite sides of the plate. The legs are formed integrally with the plate by cutting from metal stock and then bending the legs.

Preferably, the legs extend substantially perpendicularly to the plane of the plate as this is the most economical option to obtain the required embodiment depth, although in alternative versions, the legs could be inclined to the perpendicular by up to approximately 30° in either direction.

The plate may include a threaded fixing point. In one form, this can be formed by a nut welded to a rear surface of the plate in alignment with an aperture and enclosed within a separate void former, for example in the form of a plastics cup, attached to the rear side of the plate. In another form, the threaded fixing point can be formed by a rearwardly projecting integral tubular structure produced integrally with the plate by a burst extrusion process which may result in the tubular structure being of increased thickness with respect of that of the remainder of the plate. The tubular structure is then tapped and is enclosed within a separate void former, for example formed by a plastics cup attached to the rear side of the plate.

Although these methods providing a threaded fixing point have significant utility in a plate anchor formed with integral anchoring legs designed in accordance with the principles discussed above, they also have utility in more conventional forms of plate anchors such as those with anchoring formations formed by lengths of reinforcing bar bent into U shape and welded to the rear of the plate.

Accordingly, a yet further aspect of the invention provides a plate anchor for embedment into a concrete component, wherein the plate of the anchor has a fixing point formed by a threaded formation enclosed within a separate void former attached to the plate.

The threaded formation may be formed by a nut welded to the rear side of the plate or by an integral tubular structure extending to the rear of the plate and formed by burst extrusion and subsequently threaded. In either case, the void former can be formed by a separate plastics cup attached to the rear of the plate, for example by adhesive.

BRIEF DESCRIPTION OF THE DRAWINGS

Embodiments of the invention will now be described by way of example only with reference to the accompanying drawings in which.

DESCRIPTION OF THE PREFERRED EMBODIMENTS

Figure 1:
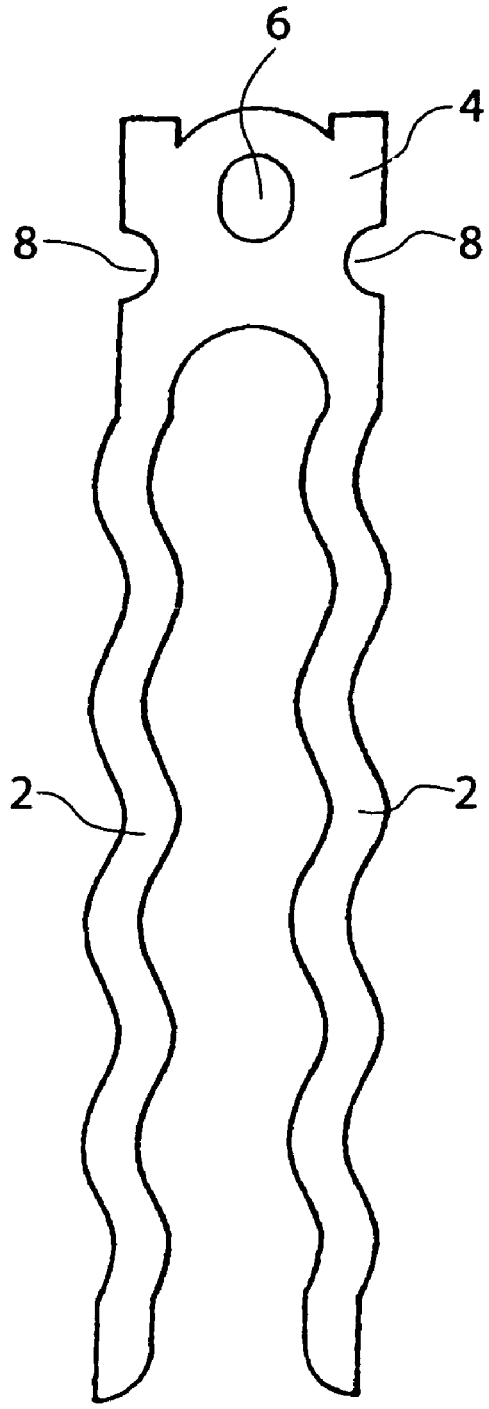
FIG. 1 PRIOR ART
FIG. 1 shows an anchor which has been widely used for edge lifting of concrete panels although it can also be used for edge lifting of other components.
Figure 2:
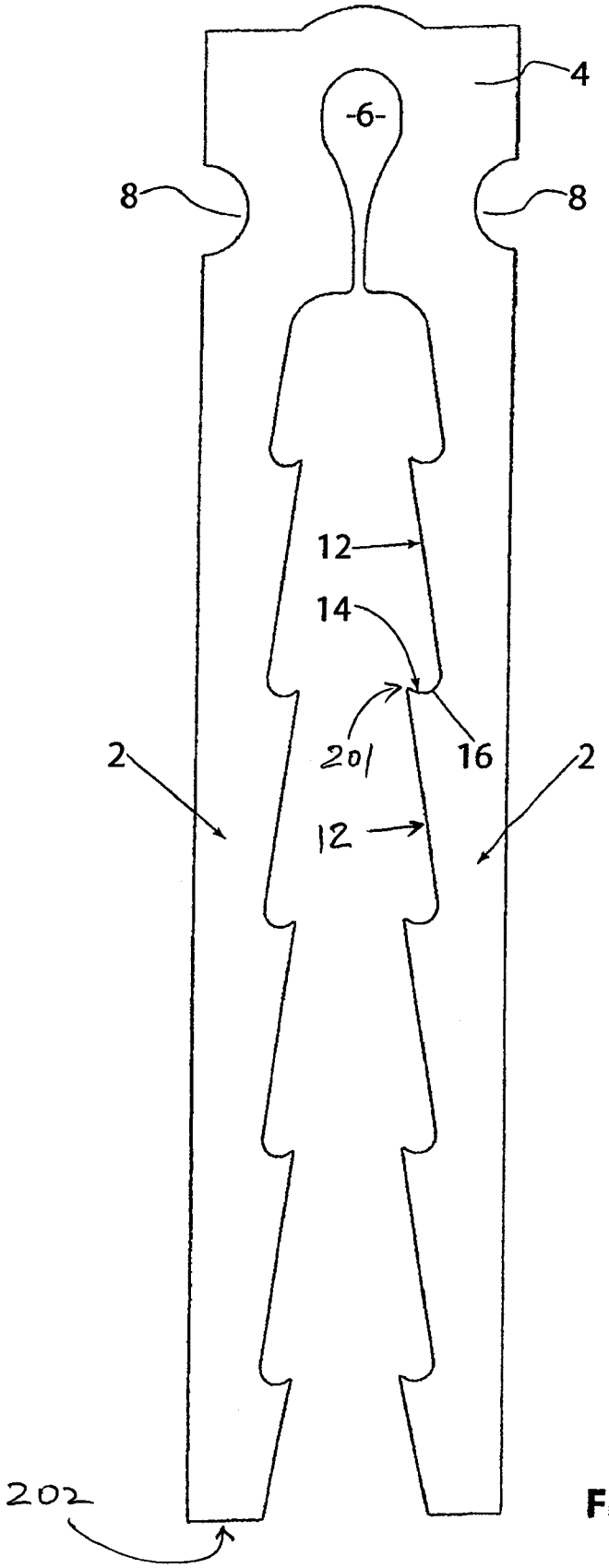
FIG. 2 is a view from the front of a lifting anchor in accordance with a preferred embodiment of the invention.
Figure 3:
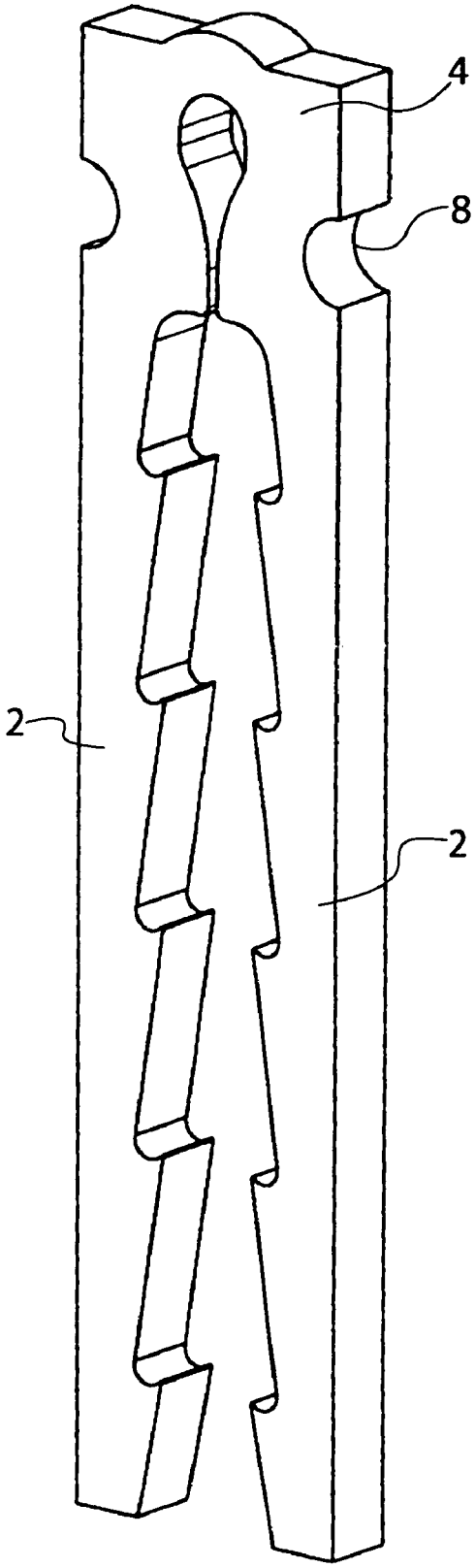
FIG. 3 is a perspective view of the anchor shown in FIG. 2.
Figure 4:
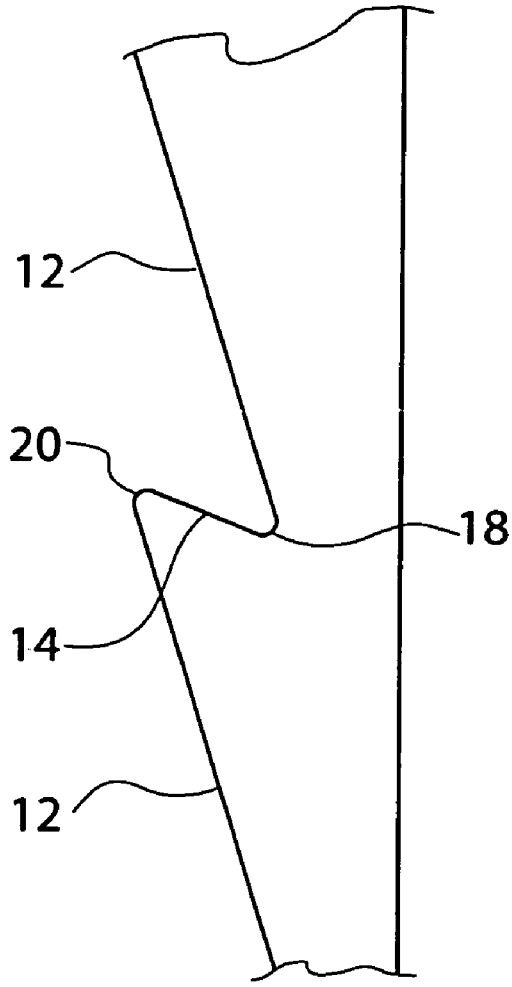
FIG. 4 is an enlarged detail showing a modified form of profiling applicable to the inner edge of each leg of the anchor shown in FIGS. 2 and 3.

The anchor shown in FIGS. 2 and 3 is of the general type shown in FIG. 1 with a head 4 for coupling to lifting apparatus and a pair of substantially parallel legs 2 extending from the head 4. The particular head 4 shown is designed for co-operation with a lifting clutch in the form of a ring clutch with an arcuate locking bolt received within the eye 6 although it is to be understood that the head 4 could be of a different detailed design for use with other types of lifting apparatus. As with the prior anchor, the anchor is cut from thick metal plate by laser beam or plasma arc cutting. In the particular form shown, the eye 6 is also laser or plasma cut as part of a continuous cutting operation as described in our U.S. Pat. No. 751,863. However the eye could alternatively be formed by a separate stamping operation after cutting the anchor.

In the conventional wave profile in the anchor in FIG. 1, the profile at the inner edge of the leg engenders, when the anchor is under load during edge lifting, a reaction with the surrounding concrete, the resultant of which is in a laterally outwards direction. Conversely, the profile at the outer edge of the leg engenders with the surrounding concrete a reaction the resultant of which acts in a laterally inwards direction. In contrast, in the anchor shown in FIGS. 2 and 3, each leg 2 is provided along its inner edge with a series of spaced profiles which lock into the concrete but which are so shaped that the resultant of the reaction between these profiles and the surrounding concrete when the anchor is under lifting load has no, or substantially no, component in a laterally outwards direction. To the contrary, the resultant of the reaction may have a component acting in a laterally inwards direction although this might not be particularly significant. As shown, each sequential series of profiles consists of an upper generally straight portion 12 inclined laterally outwardly in a downwards direction (in other words a direction away from the head 4) merging into a portion 14 which is inclined upwardly to face the head 4 and laterally inwardly. It is this latter portion 14 which locks into the concrete under load and it is this portion that principally takes the loading between the leg and the surrounding concrete. It will be understood that as a result of the inclination of the load-carrying locking portion 14 upwardly and laterally inwardly the resultant of the forces acting on the leg as a result of the inter-engagement will act laterally inwardly, in other words away from the adjacent face of the panel. This not only avoids "burst through" of the leg into the panel face under load but also causes the leg to lock tighter into the concrete as the load increases. From what is shown in FIGS. 2 and 3 and also FIGS. 4 to 12 to be described subsequently, it will be understood that the profiling can be described as being formed by a series of formations of saw-tooth like shape with the leading face thereof which represents the locking portion facing towards the head of the anchor.

In the form shown, the portion 12 merges into the load-carrying locking portion 14 via an arc 16 of large radius which actually continues so as to form the locking portion 14. The locking portion 14 ends at an apex 201 which has a radius smaller than that of the arc 16 and from which a next portion 12 extends toward a flat end 202 of the leg. In addition to the basic requirement of shaping the profile to achieve the type of locking action discussed above, it is also in practice necessary to ensure that the profile is able to be cut efficiently using laser or plasma cutting techniques and this may result in some variation from that shown. For example, in the detail shown in FIG. 4 the locking portion 14 is more rectilinear in shape and merges at its lower end with the end of the downwardly inclined portion 12 via a small radius 18, and its upper end merges with the upper end of the following downwardly inclined portion 12 by a similar small radius 20. In one example the angles included between the portions 12 and 14 are the order of 15°.

It is to be understood that the invention is not restricted to the particular profiles shown and other profiles which lock into the concrete without engendering a resultant laterally outwards reaction on the leg could alternatively be used. Examples of other forms of profile are shown with reference to the embodiments of FIGS. 8 to 12.

As the inside leg profile is such that the leg is not required to be of a length to avoid the "burst through" condition previously described, the requisite load can be carried using shorter legs than was necessary in a comparable anchor of the form shown in FIG. 1. Accordingly the material costs for the anchor are reduced and also installation may be quicker in some circumstances.

Preferably, each leg 2 progressively tapers in width towards its lower end. Therefore, the upper part of each leg which carries the maximum part of the load can be made of increased width and this is offset by the reduced width at the lower end. This is of significance in terms of material costs as anchors of this type are typically cut out of the metal plate in an inverted interlocking array whereby during cutting, the leg of one anchor is cut out of the plate material between the two legs of a second anchor inverted with respect to the first.

Due to the locking interaction with occurs between the surrounding concrete and inside leg profile as described, it is not necessary to profile the outer side of the leg and in fact it is particularly preferred that the outside of the leg is straight as shown, as this significantly facilitates manufacture as a straight cut using a laser or plasma cutting machine can take place much more quickly than cutting along a path involving continual changes of direction.

Figure 5:
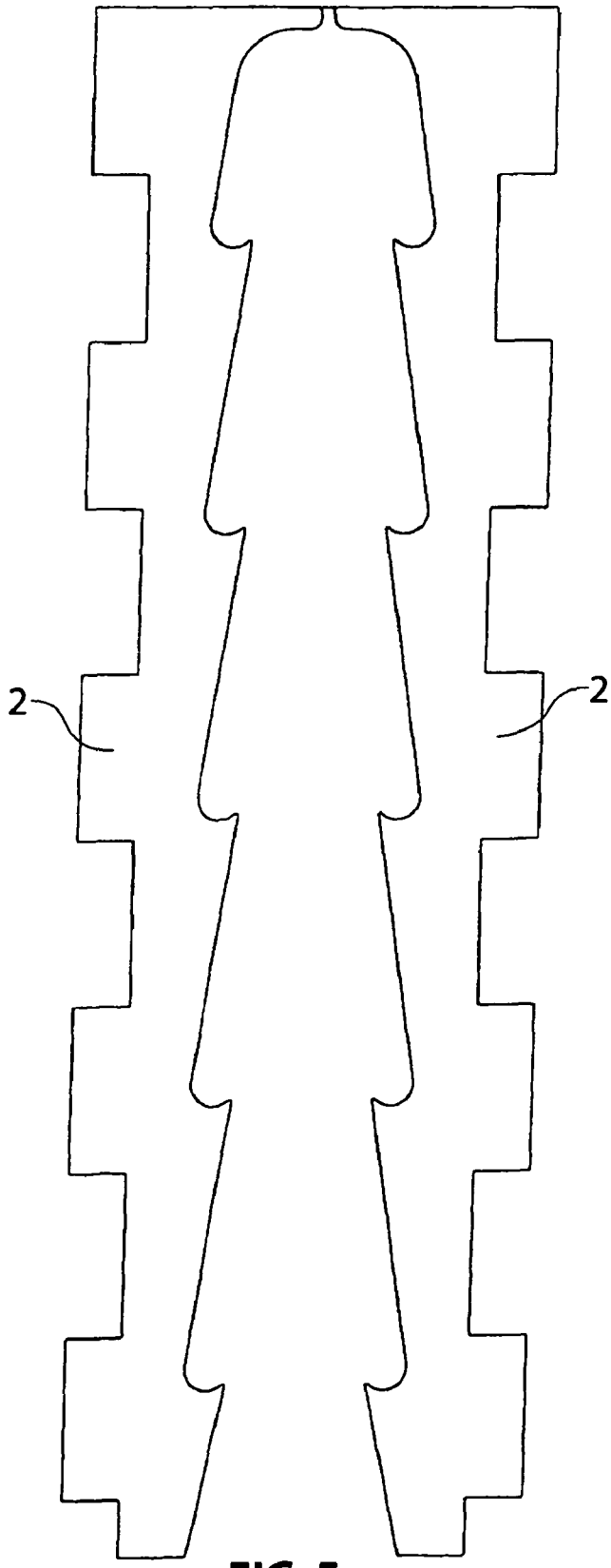
FIGS. 5 to 7 are fragmentary views of anchors of the type shown in FIGS. 2 and 3 but with profiling along the outer edge of each leg.
Figure 6:
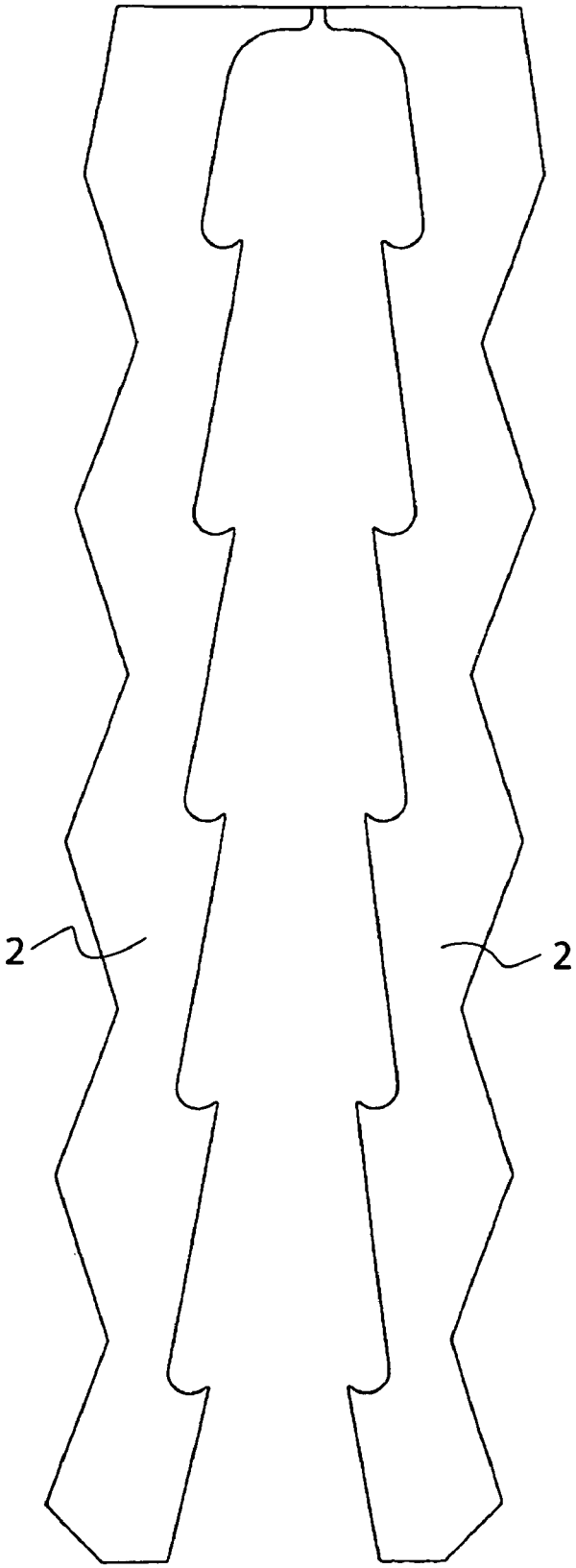
Figure 7:
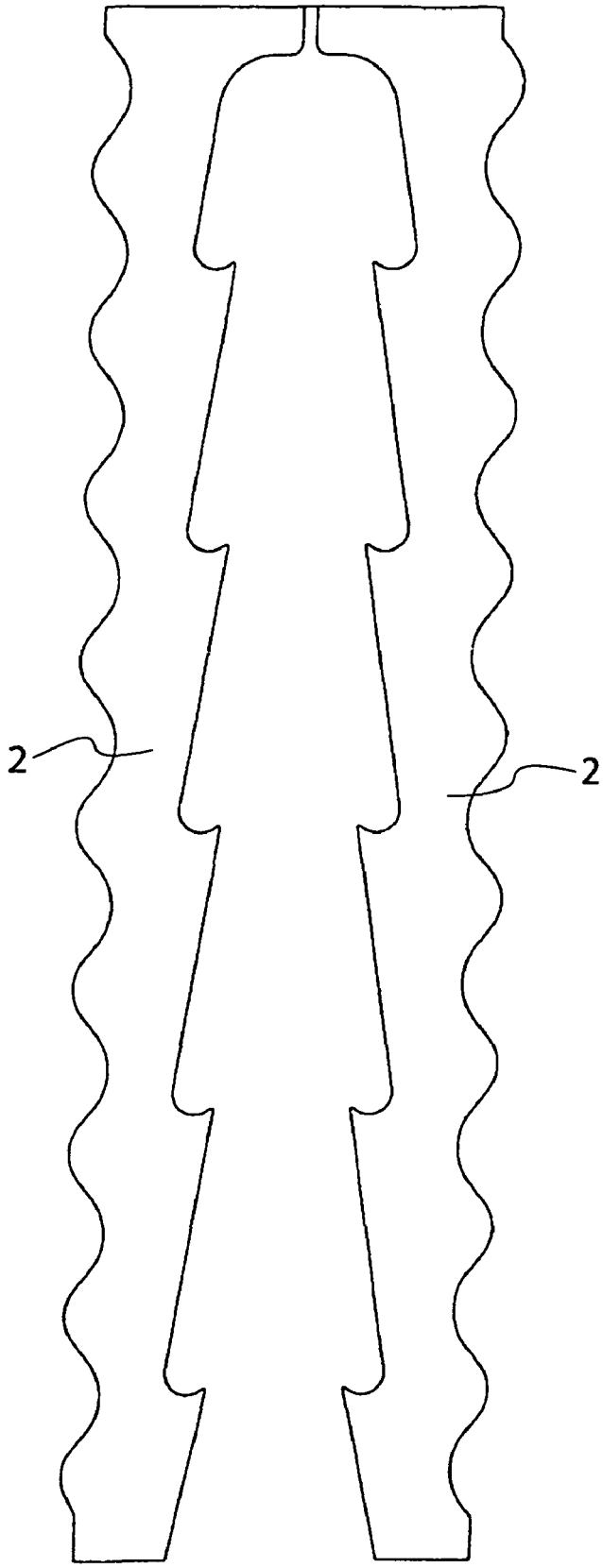

Although it is particularly preferred that the outer edge of the leg is straight for the reasons just discussed, nevertheless it is within the scope of the invention for the outer edge of the leg to be profiled to further improve the lock with the concrete and possible forms of profiling for the outer edge are shown in FIGS. 5 to 7. It is to be noted that none of these outer edge profiles are such as to engender a laterally outwards reaction force on the leg and in fact those shown in FIGS. 6 and 7 will engender a laterally inwards reaction to add to that engendered by the profiling of the inner edge.

Although preferred embodiments of the present invention use an inside leg profile which does not engender an outwards lateral reaction and a straight outer edge profile which facilitates cutting of that edge, it is envisaged that a straight cut outer edge could, due to its manufacturing advantages, have utility in an anchor shaped along its inner edge with a more conventional meandering or wave like profile such as that shown in FIG. 1. In that case however it is likely that the overall leg length may need to be increased somewhat to ensure that "burst through" can not occur having regard to the reduced counteracting forces which will be present in this mode.

Figure 8:
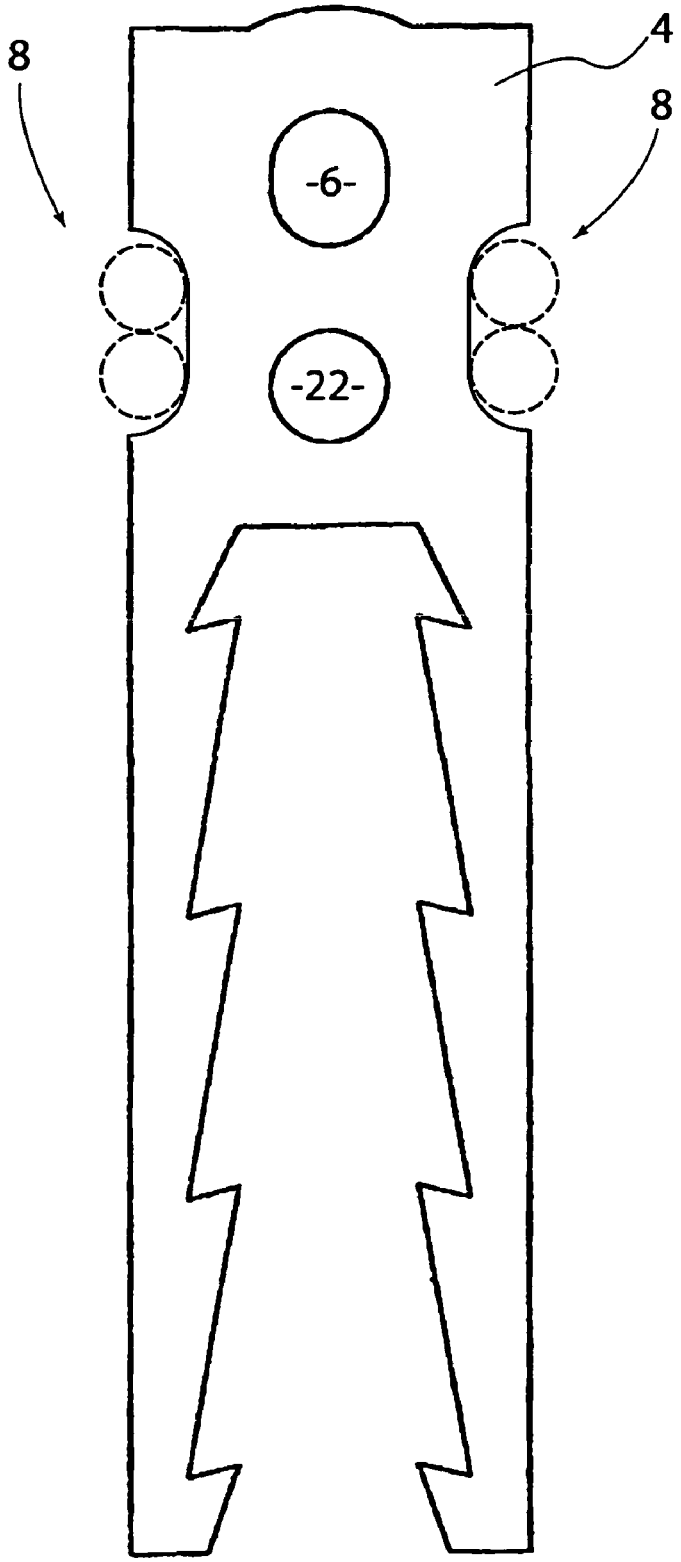
FIG. 8 shows a modification to the anchor to accommodate further reinforcement in a concrete panel.

FIG. 8 shows a variation in which the apertures 8 in the anchor head are lengthened so that each can accommodate two reinforcing bars, specifically a shear bar and an upper perimeter bar of the panel itself. This modification would also have applicability to other forms of anchor such as that shown in FIG. 1.

FIG. 8 shows the anchor head 4 as being of extended length to accommodate an aperture 22 beneath the eye 6 for receiving a tension bar to increase the load capacity of the anchor and this variation can apply to all of the anchors described herein. However as a result of the locking action of the legs relative to the concrete between the legs as previously discussed, and which provides a different type of failure mode for the anchor in relation to that of prior anchors as shown in FIG. 1, a tension bar can, alternatively, be installed between the two legs within the upper part of the space between the two legs as it is not, now, necessary for there to be physical interaction between the tension bar and the anchor itself in order to achieve the required effect. It follows from this that the higher loading capacity achieved when the tension bar is installed between the legs does not require the use of a larger head with the aperture for the tension bar. This not only reduces material costs but also it reduces manufacturing costs as the tension bar aperture is no longer required.

Figure 9:
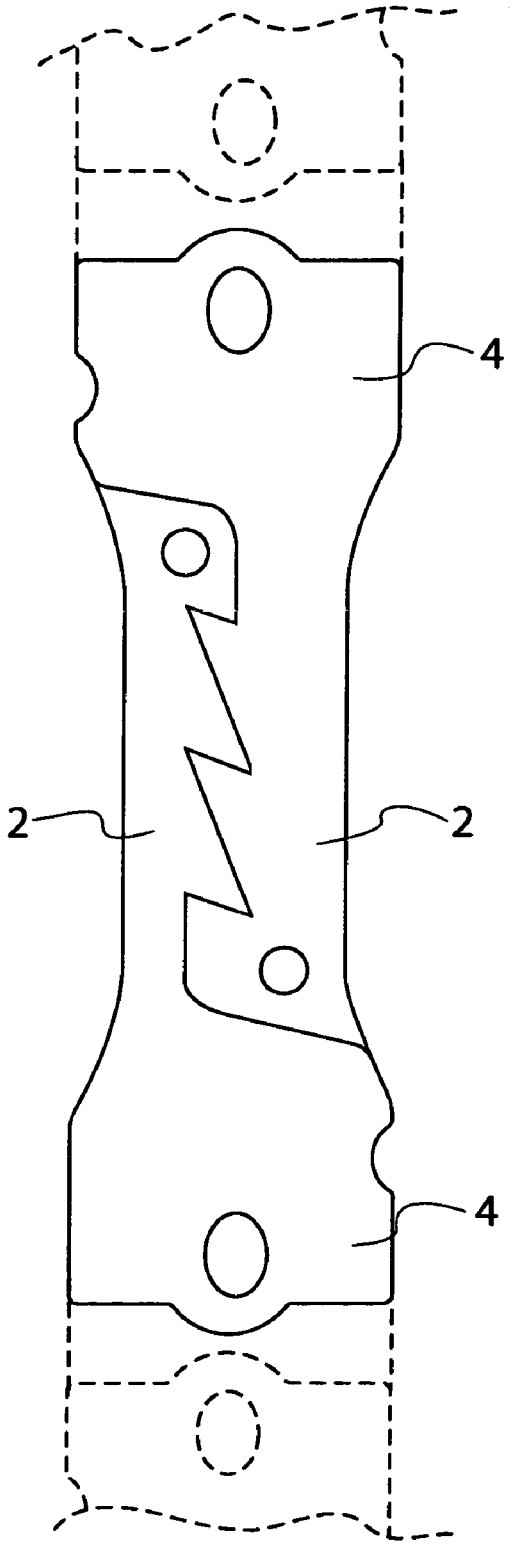
FIG. 9 shows schematically a modified anchor having only a single leg.

FIG. 9 shows a variation in which the anchor only has a single leg 2 profiled in accordance with the principles described above. As shown, the leg is positioned asymmetrically relative to the anchor head 4 so that its straight edge will lie closer to the adjacent face of the panel than will its profiled edge. This asymmetry also allows pairs of anchors to be produced in inverted relationship as shown with minimal wastage of material. This form of anchor can be cut in this way from a metal plate by laser beam or plasma arc cutting, or it could also be punched from flat bar.

The principles described above are also applicable to other forms of cast-in anchor such as plate anchors for providing fixings for use post-erection of the concrete component, for example panel-to-panel fixings and connections for beams. Current forms of plate anchor generally comprise a plate with lengths of reinforcing bar bent into U shape and welded to the rear of the plate; a threaded fixing point may be provided by an internally threaded ferrule welded to the rear of the plate in alignment with an aperture in the plate.

Figure 10:
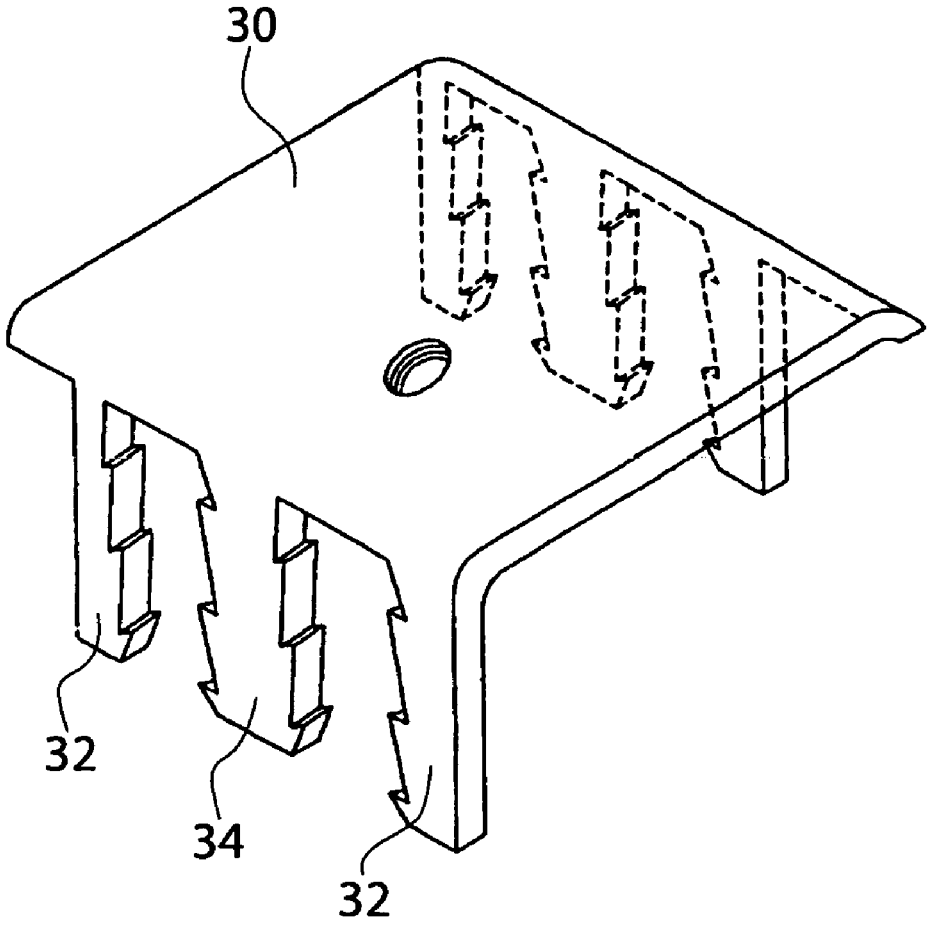
FIG. 10 is a perspective view of a plate anchor.
Figure 11:
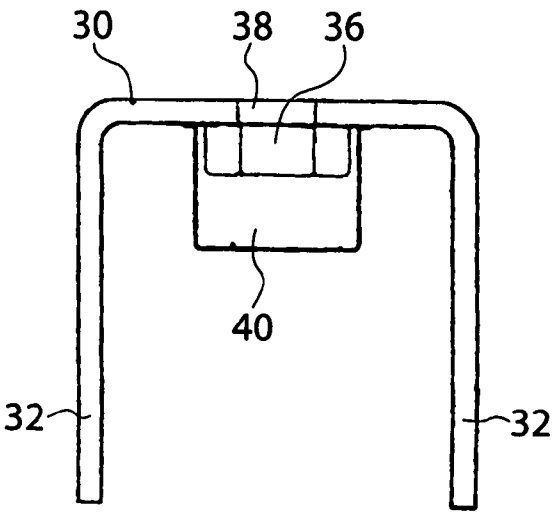
FIG. 11 is a side view of the anchor shown in FIG. 10.
Figure 12:
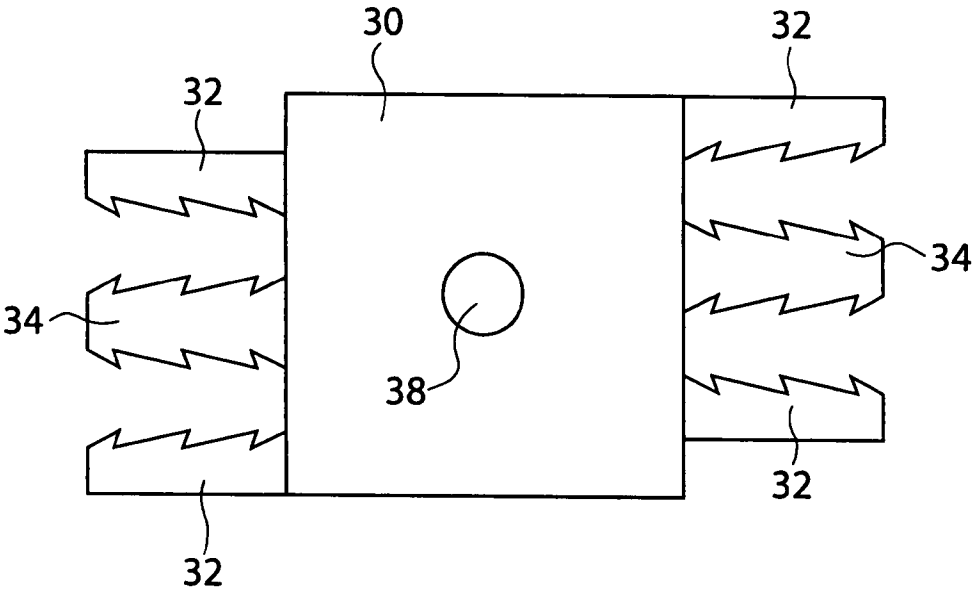
FIG. 12 is a plan view showing the plate anchor after cutting from metal plate material and prior to bending of the legs.

With reference to FIGS. 10 to 12, a plate anchor constructed in accordance with the principles of the present invention is formed with sets of anchoring legs extending from opposite edges of a plate 30 transversely to the plane of the plate. In the embodiment shown each set of legs has three legs, two outer legs 32 and an intermediate leg 34 although in other versions having reduced load requirements and of reduced size each set of legs may consist just of the two outer legs. It is also conceivable that just a single leg equivalent either to the leg 32 or the leg 34 could be provided at each side of the plate 30 in further versions of the anchor. The inner edge of each outer leg 30 is profiled in the manner previously described as are both edges of the intermediate leg 34; as shown, the outer edge of each leg 32 is straight.

The plate anchor with integral legs is cut from metal plate of required thickness (see FIG. 12) and the legs are then bent so as to extend substantially perpendicular to the plane of the plate. It will be noted that in the preferred embodiment the two sets of legs are asymmetrically arranged with one set laterally offset relative to the other set. As a result of this asymmetry, successive anchors can be cut from the plate with a minimum of wastage as the legs of one anchor are cut from the material lying between the legs of adjacent anchors.

Although it is preferred that the legs are bent so as to extend substantially perpendicular to the plane of the plate as this is the most economical option to provide a required embedment depth for a given leg length, it would be feasible for the legs to be inclined by up to approximately 30° in either direction relative to the plane of the plate. In that case for the same embodiment depth, the legs would then be commensurately longer whereby the amount of concrete engaged would be increased thereby increasing the load-bearing capacity of the anchor.

In the embodiment shown, the plate anchor provides a threaded fixing point provided by a nut 36 welded to the rear of the plate 30 in alignment with an aperture 38 cut into the plate. The nut lies within a plastics cup 40 attached to the rear of the plate, for example by adhesive, and which acts as a void former behind the nut to form a void in the cast concrete and into which a threaded fastening can extend. Alternatively, the plate 30 can be subject to a so-called burst extrusion process which forms a rearwardly projecting integral tubular structure of increased thickness which can then be tapped to receive a threaded fastener. This, likewise, is associated with a plastics cup attached to the rear of the plate and acting as a void former. It is to be understood that the presence of a threaded fixing is not essential although it will be required in some situations. If it is required, it's provision either by the nut welded to the rear of the plate or the tapped burst extrusion in conjunction with the plastic void former will provide a reduced cost option in relation to the incorporation of an internally threaded ferrule in accordance with current practice. It is therefore envisaged that these methods of providing a threaded fixing point in a cast-in plate anchor would also have benefit in more conventional plate anchors in which anchorage within the concrete is achieved by bent lengths of reinforcing bar welded to the rear of the plate.

The embodiments have been described by way of example only and modifications are possible within the scope of the invention.

The invention claimed is:

1. An anchor embedded in a concrete component, the anchor comprising:

a head via which load is applied to the anchor in use; and an anchoring formation provided by at least one leg extending from the head and having, along an edge thereof, a profile locked into the surrounding concrete, the profile being formed by a series of longitudinally spaced formations each of generally saw-toothed shape with a leading edge of each formation inclining towards the head such that on application of a pulling load to the head the leg will lock tighter into the concrete with increasing load;

wherein said anchor is a flat member having two opposite major surfaces that extend continuously without interruption throughout the head, into the at least one leg and throughout said at least one leg;

wherein the anchor is a lifting anchor having a pair of such legs extending from the head which is adapted for releasable engagement with lifting equipment, said formations being along an inner edge of each of the legs.

2. An anchor according to claim 1, wherein the anchor is a plate anchor further comprising:

a plate; and a set of such legs extends from each of two opposite sides of the plate transversely to the plane of the plate, each set of legs comprising at least two parallel legs, and said formations being along an inner edge of each of said legs.

3. A lifting anchor for embedment into a concrete component, the lifting anchor comprising:

a head configured for releasable engagement with lifting equipment; and at least one pair of legs integral with the head;

wherein each leg comprises, along one of laterally opposite edges thereof, a series of longitudinally spaced, saw-toothed formations each of which includes a first section extending laterally away from the other edge and toward the head and ending at an apex of said saw-toothed formation; and a second section extending from the apex laterally toward the other edge and away from the head, and being slanted at an acute angle with respect to the first section;

wherein the apexes of the saw-toothed formations of one of said legs are arranged along a first straight line, the apexes of the saw-toothed formations of the other one of said legs are arranged along a second straight line substantially parallel to the first line; and wherein said head comprises an eye for releasable engagement with lifting equipment; and a slit extending from the eye toward the legs, wherein said slit has a width smaller than a diameter of said eye and is positioned between the eye and the apex of a closest one among said saw-toothed formations.

4. An anchor according to claim 3, wherein, for each leg, the second section of each formations is connected to the first section of a subsequent formation by a radiused section; and said radiused section has a radius greater than that of the apex formed between the first and second sections of the same formation.

5. An anchor according to claim 3, wherein the formations are longitudinally arranged along the facing edges of said legs.

6. An anchor according to claim 3, wherein the head comprises, on opposite outermost sides thereof, concave portions for engagement with reinforcing bars of the concrete component, said concave portions being at least partially coelevational with said eye.

7. An anchor according to claim 3, wherein each said leg terminates at a flat end.

* * * * *